US006688484B2

(12) United States Patent
Boulange et al.

(10) Patent No.: US 6,688,484 B2
(45) Date of Patent: Feb. 10, 2004

(54) TAMPER EVIDENT CONTAINER CLOSURES

(76) Inventors: Michel Boulange, c/o American Flange 290 E. Fullerton Ave., Carol Stream, IL (US) 60188; Philippe Davous, c/o American Flange 290 E. Fullerton Ave., Carol Stream, IL (US) 60188

( * ) Notice: Subject to any disclaimer, the term of this patent is extended or adjusted under 35 U.S.C. 154(b) by 153 days.

(21) Appl. No.: 09/942,287

(22) Filed: Aug. 30, 2001

(65) Prior Publication Data

US 2002/0030054 A1 Mar. 14, 2002

(51) Int. Cl.[7] ..... B65D 41/32; B65D 39/08

(52) U.S. Cl. ..... 220/284; 220/266; 215/252; 215/215; 81/176.15

(58) Field of Search ..... 220/212.5, 276, 220/266, 284, 285, 286, 274; 225/215, 330, 252, 219, 220; 81/124.3, 121.1, 124.7, 176.1, 176.15; 53/334, 329, 331.5, 490, 471

(56) References Cited

U.S. PATENT DOCUMENTS 3,253,963 A * 5/1966 Sabatino ..... 429/89
4,308,969 A 1/1982 Heisler et al.
4,785,963 A 11/1988 Magley
5,220,767 A * 6/1993 de Santana ..... 53/331.5
H1777 H * 2/1999 Colby ..... 53/331.5
5,915,579 A * 6/1999 Przytulla et al. ..... 215/252
6,325,225 B1 * 12/2001 Druitt et al. ..... 215/252

FOREIGN PATENT DOCUMENTS

DE 9109185 U 12/1992

* cited by examiner

*Primary Examiner*—Lee Young
*Assistant Examiner*—James Smalley

(57) ABSTRACT

Disclosed herein is a method and apparatus for closing a container (10) with a tamper evident closure (26) wherein the closure has a tamper evident ring (38) with driving features (52) that enable a given closure fitting tool (54) with driving features (60) complementary to those of the closure and the ring to be used to drive the closure and the ring onto the container neck (12) without exerting closing torque on the frangible links (40), the links may be made more readily frangible than heretofore; in an embodiment the ring driving features are one-way to prevent the tool from being used to open the container without breaking the links.

7 Claims, 5 Drawing Sheets

TAMPER EVIDENT CONTAINER CLOSURES

This invention relates to anti-tamper closures and it particularly, but not exclusively, relates to closures having tamper evident features for blow-moulded containers.

A known tamper evident container closure comprises a container having a neck in combination with a closure for the container neck, the neck and closure having rotatably interengaging features whereby the closure can removeably close the neck and seal the container and a continuous or segmented tamper evident ring attached by frangible links to the closure, the ring and the container neck having complementary one-way features that, in use, permit closing rotation of the closure and ring relative to the container but which interact to prevent opening rotation of the ring and thereby break the frangible links to provide tamper indication. The closure and tamper evident ring are usually integrally-formed of plastics by injection-moulding and the container necks with the one-way features are either separate plastics mouldings welded or other-wise attached to a container or the container is, preferably, a unitary plastics blow-moulding with all neck features being formed integrally with the container. Such 220 liter (55 gallon) containers are rapidly becoming a standard in many industries, including containers for drink concentrates.

Documents EP-A-0 324 196; U.S. Pat. No. 4,308,969; DE-A-30 10 769; U.S. Pat. No. 4,607,759 disclose examples of this type of tamper evident container closure. There are problems with this type of container closure. One problem is that the closure has to be fitted to the container by relative rotation of the closure with the one-way features riding one over the other until the closure closes and seals the container neck, this exerts a significant closing torque or relative turning force between the closure and the ring and the links have to be strong enough to resist this force. These "strong enough" links are either too strong for the closure to be readily removable or, more importantly, can permit the closure to be rotated off the container without breaking the links; as the ring can ride backwards over the one-way features without breaking some or all of the links. Another problem is that the fitting of closures to containers is often mechanised and the closing torque set for closure rotation, to ensure a reliable seal between the closure and the neck of a blow-moulded container is often so high that the links can break on driving the closure onto the container neck.

SUMMARY OF INVENTION

The present invention provides a solution to the above-stated problems.

According to the present invention, a method of fitting a tamper evident container closure to the neck of a container is carried out by:

providing rotatably interengaging features on the container neck and closure by which the closure can removeably close the neck and seal the container;

attaching a continuous or segmented tamper evident ring by frangible links to the closure;

providing complementary one-way features on the ring and the container neck that, in use, permit closing rotation of the closure relative to the container but which interact to prevent opening rotation and thereby break the frangible links;

providing the closure and the tamper evident ring with driving features;

providing a closure fitting tool with driving features complementary to those of the closure and the ring;

loading the fitting tool with a closure;

offering the tool to a container neck; and, rotating the tool with respect to the container to drive the closure and the ring onto the neck.

By this means, the closure tool effectively bridges the frangible links and exerts closing torque directly on the tamper evident ring as well as on the closure such that the links can be more readily frangible as they do not have to transmit closing torque from the closure to the ring.

It is known to provide a tamper evident container closure with a driven tamper evident ring in the form of a one-way feature depending from the closure and engaging a complementary one-way feature of the ring. Not only is such a closure more difficult to mould than a closure for the method of the present invention but the complementary one-way driving features can make the closure difficult to undo.

In an accordance with the present invention, the complementary tamper evident ring is provided with one-way driving features, to thereby prevent rotation of the tool in the opening direction from driving the tamper evident ring. This prevents a closing tool being used to open a container without breaking the frangible links.

The above and other features of the present invention are illustrated, by way of example, in the Drawings, wherein.

DETAILED DESCRIPTION OF THE INVENTION

Figure 1:
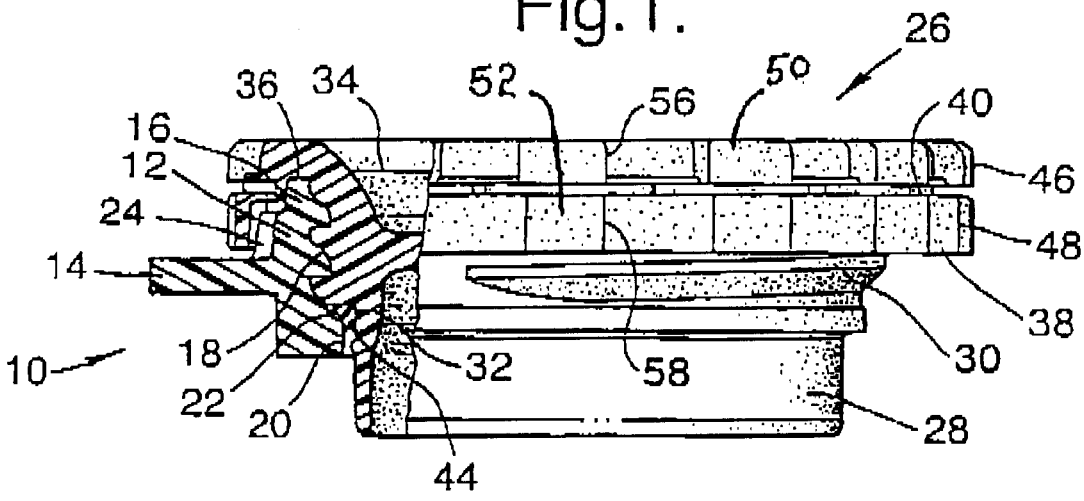
FIG. 1 is a part-sectioned elevation of a tamper evident container closure in a container neck and in accordance with a first embodiment of the present invention.
Figure 2:
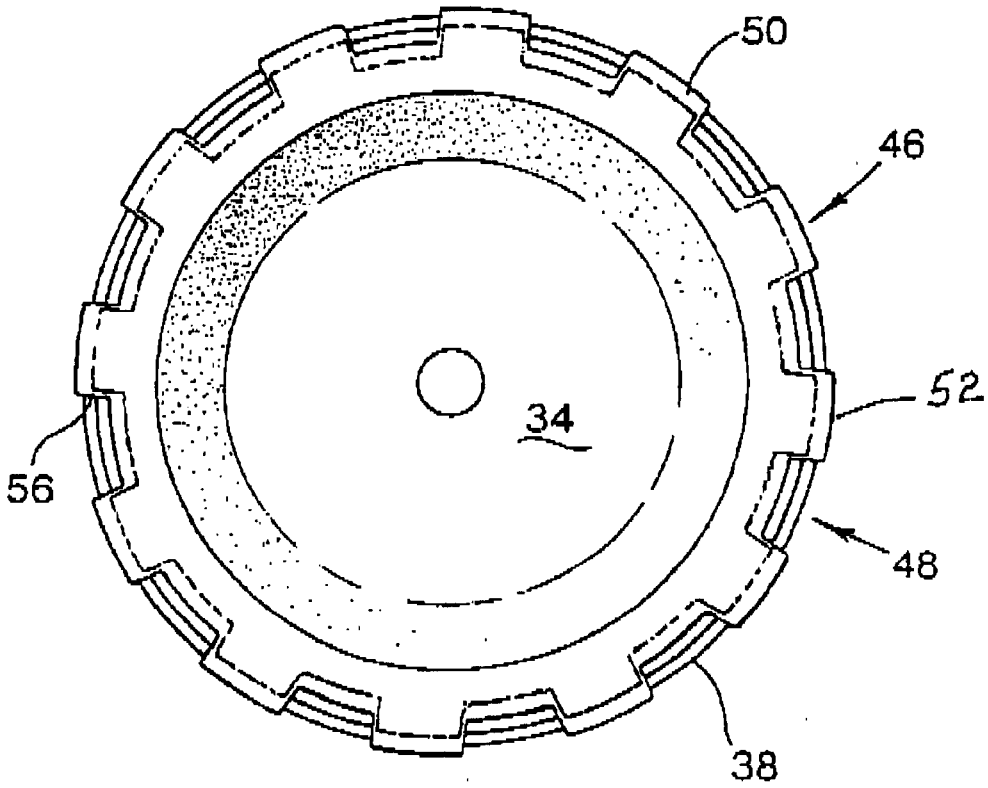
FIG. 2 is a plan of the closure of FIG. 1.

As shown by FIG. 1, a container wall 10 which may be in a 220 liter drum blow-moulded from plastics material such as HDPE high density polyethylene, has a neck 12 extending from the upper surface 14 of the drum.

The integrally moulded neck 12 projects both axially outwardly from the recessed drum surface 14 and axially inwardly into the drum. The neck 12 has a rim 16, an internal thread 18 and a radially inwardly directed flange 20 located axially inwards of the screw thread 18. Flange 20 has an axially outwardly directed, frusto-conically shaped sealing counterface 22. A series of radially outwardly extending, anti-tamper ratchet teeth 24 are formed about the axially outwardly extending part of the neck 12.

As shown by FIGS. 1 to 4, a closure cap 26 is moulded from plastics material, such as PE polyethylene or PP polypropylene, to have a generally axially cylindrical body 28 with a thread 30 formed on the exterior surface thereof. A radial peripheral groove 32 is located under the cap screw thread 30. The cap top 34 has a radially outwardly extending flange, the underside of which has an axial groove 36 of complementary cross-section to the container neck rim 16.

An annular tamper evident ring 38 is connected to the cap top 34 by axial frangible links 40. The inner surface of the anti-tamper ring 38 is provided with radially inwardly extending anti-tamper ratchet teeth 42 which are, in known manner, shaped to pass over container neck anti-tamper ratchet teeth 24 when the cap 26 is rotated into the neck 12, but to interlock therewith when the cap is rotated out of the neck, to break the links 40 and provide anti-tamper indication. The anti-tamper ring 38 is moulded with the cap 26.

A sealing ring 44 of generally rectangular or round cross-section is located in the cap radial groove 32.

Figure 5:
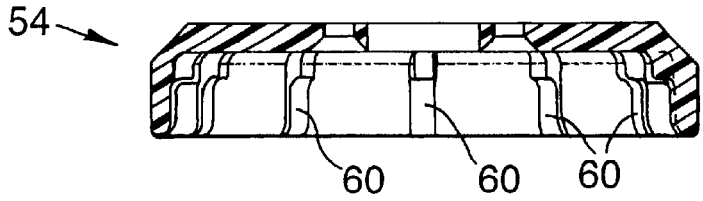
FIG. 5 is a sectional elevation of a closure fitting tool for closure of FIG. 1.
Figure 6:
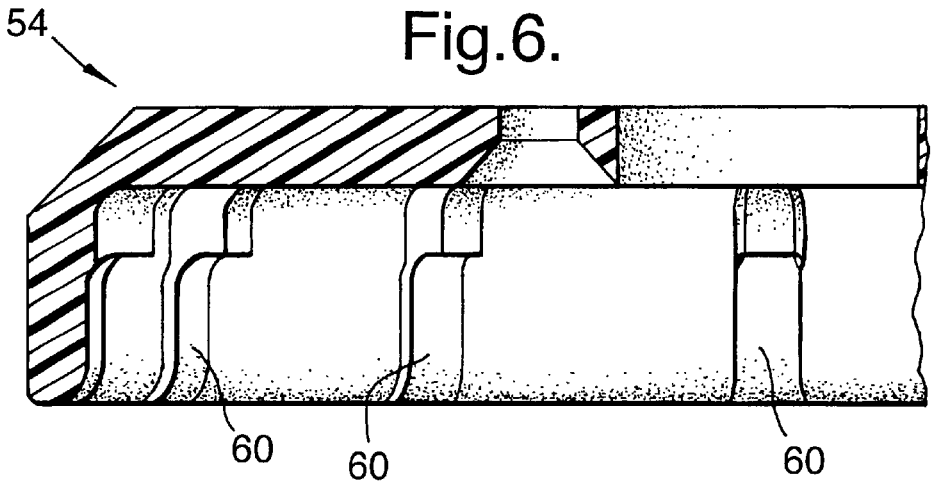
FIG. 6 is an enlarged detail of the closure fitting tool of FIG. 5.
Figure 7:
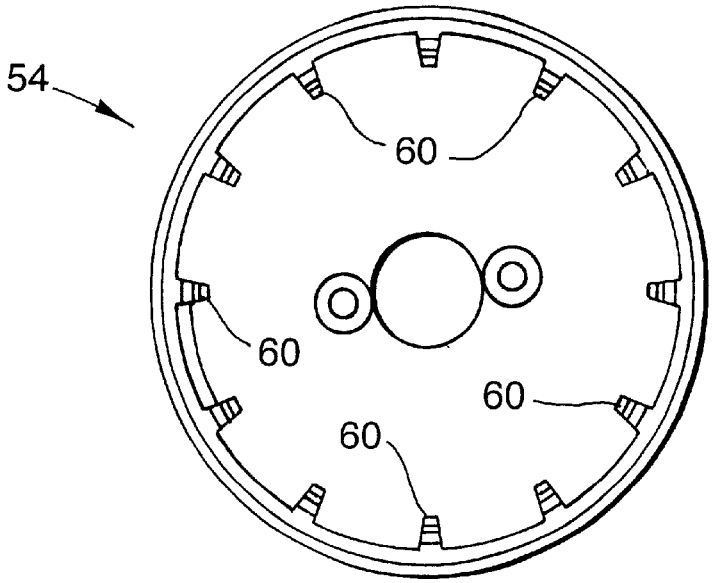
FIG. 7 is an underplan of the closure fitting tool of FIG. 5.

The outer peripheral rim 46 of the cap top 34 and the outer peripheral rim 48 of the tamper evident ring 38 are castellated at 50 and 52 for ready engagement by the metal head 54 of an automatic cap fitting and closing tool (FIGS. 5 to 7), the head is shaped to engage both the cap and the ring to ensure that the links 40 are not inadvertently broken as the cap is being screwed onto the neck.

Figure 3:
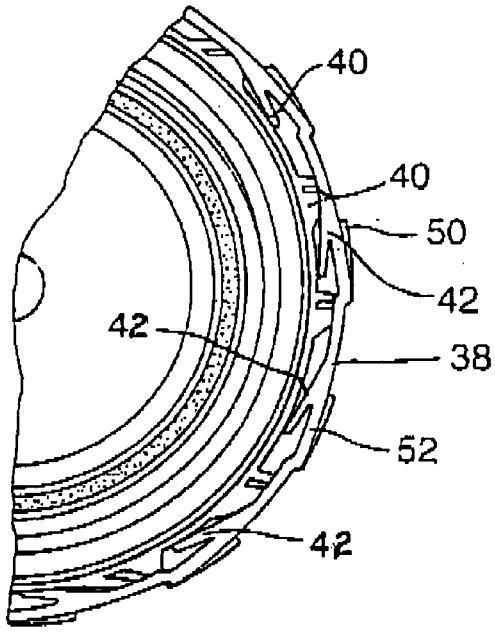
FIG. 3 is a part underplan of the closure of FIG. 1.
Figure 4:
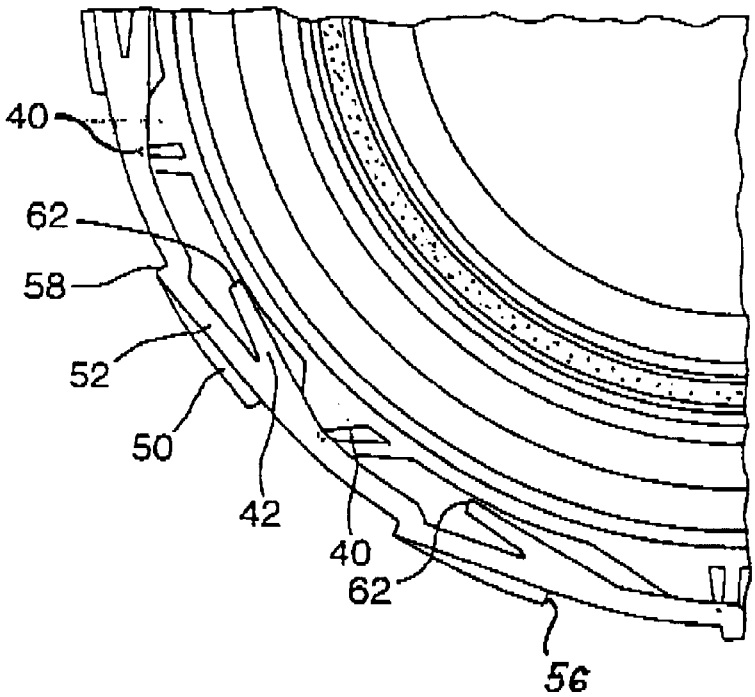
FIG. 4 is an enlarged detail of the closure of FIG. 1.

As shown more clearly in FIGS. 3 and 4, the cap top castellations 50 and the tamper evident ring castellations 52 form driving features, having axially aligned leading radial edges 56 and 58 that are picked up by radially inwardly directed axial splines 60 of the cap fitting tool 54; the inner depth of the cap fitting tool being sufficient to engage both castellations 50 and 52 when the cap is loaded into the tool. When used to fit a cap 26 to a container neck 12, the tool will drive directly both the cap and the tamper evident ring 38 so that no closing torque is imparted to the frangible links 40.

Whilst the cap castellations 50 are shown to be conventionally rectangular, to serve both as closing driving features and subsequent opening features, the tamper evident ring castellations 52 are shown to be wedge- or cam-shaped, tapering radially inwardly from the leading edge 58 into the ring peripheral rim 48. This shape enables these tamper evident ring castellations 52 to have a one-way driving effect; whilst the cap fitting tool splines 60 can pick up and drive the tamper evident ring castellations 52 in the closing direction they will ride over the castellations when the tool is turned in the reverse, opening direction. Thus no opening driving action can be exerted by the tool on the tamper evident ring, it can only exert an opening driving action on the cap castellations 50, consequently opening torque will be transmitted to and break the frangible links 40.

Additionally, the tamper evident ring anti-tamper ratchet teeth 42 are shown to be vanes trailing radially inwards and in the cap closing rotational direction, the vane free ends 62 riding over the container neck ratchet teeth 24 when the cap 26 is rotated in the closing direction but locking against the container neck ratchet teeth 24 when the cap is rotated in the opening direction. The vanes permit the tamper evident ring 38 to flex radially inwardly and thus break the frangible links 40 if an attempt to open the container 10 is made by use of a cap fitting tool 54. This action being in addition to transmission of container opening torque to the frangible links 40 described in the previous paragraph.

Figure 8:
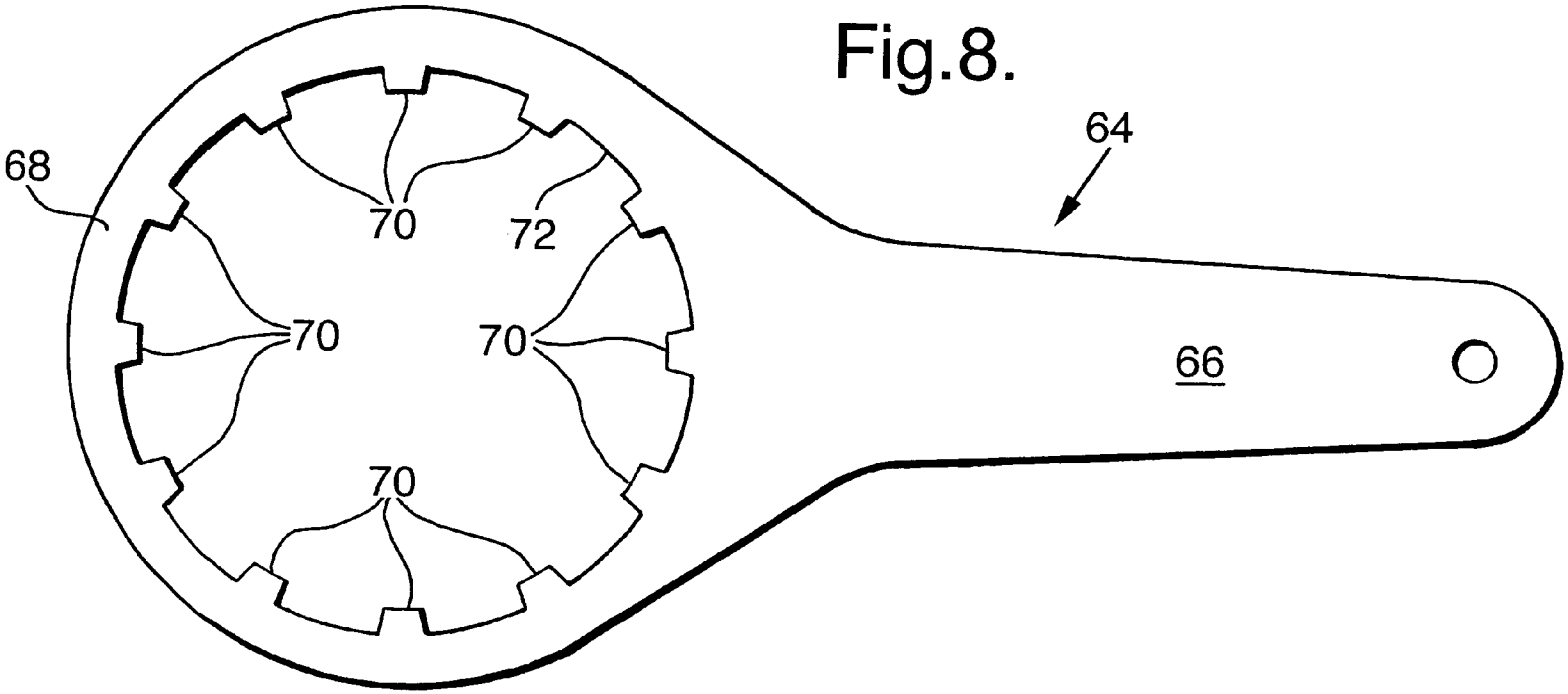
FIG. 8 is a plan of a closure opening tool for the closure of FIG. 1.
Figure 9:
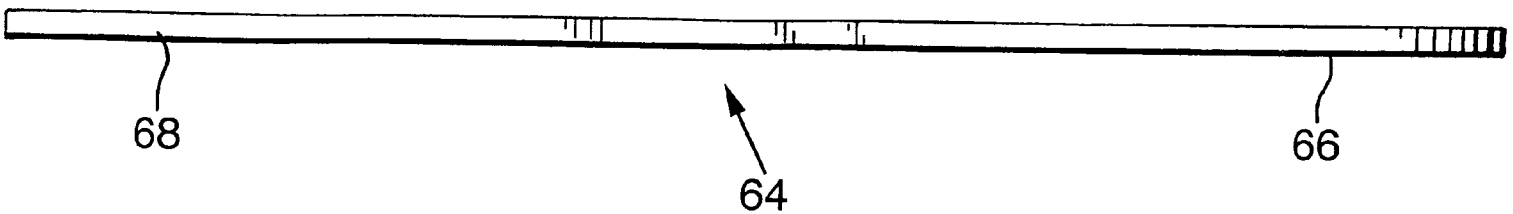
FIG. 9 is an elevation of the closure opening tool of FIG. 8.

The container 10 can be opened by the use of the opening tool 64 shown in FIGS. 8 and 9. The tool has a handle 66 and a ring 68 having a diameter to pass over a cap 26 and radially inwardly directed castellations 70 about the inner periphery 72 of the ring, the inner and castellations being complimentary in shape to the cap peripheral rim 46 and cap castellations 50. The opening tool is required because of the high closing torque exerted on the cap by the automating closing machinery.

Figure 10:
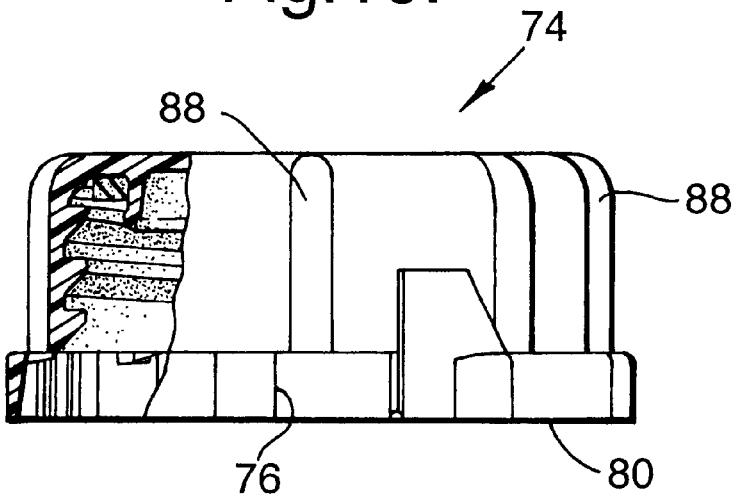
FIG. 10 is a part-sectioned elevation of a tamper evident container closure in accordance with a second embodiment of the present invention; and, FIG. 11 is an underplan of the closure of FIG. 10.
Figure 11:
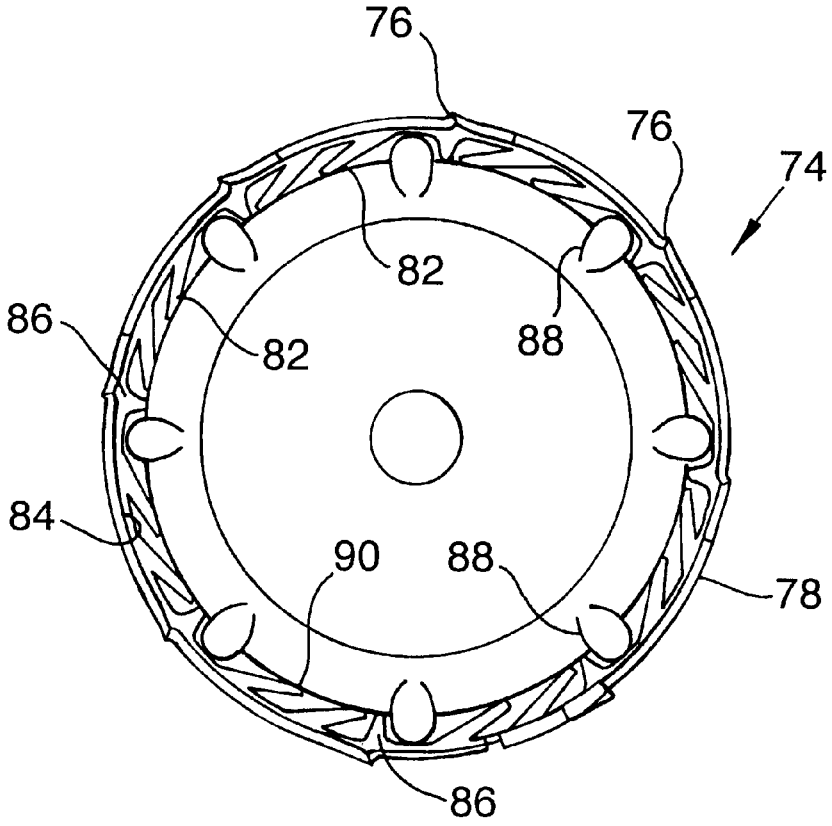

A second embodiment of a tamper evident closure cap in accordance with the present invention is shown by FIGS. 10 and 11. In this embodiment, a DIN 60 type screw closure cap 74, being a HDPE high density polyethylene moulding of generally known type, has wedge- or cam-shaped, one-way driving features 76 formed in the peripheral rim 78 of the tamper evident ring 80. Anti-tamper vanes 82 are formed in the inner periphery 84 of the tamper evident ring 80, which is joined to the cap 74 by radial frangible links 86. The cap 74 has a series of radially outwardly and axially extending ribs 88 equispaced about the cap periphery 90 and which constitute cap driving features. These driving features 76 and 88 are not axially aligned; unlike the cap and ring driving features 50 and 52 of the first embodiment.

What is claimed is:

1. A tamper evident closure for threaded engagement with a container opening neck, a tamper evident ring surrounding said closure, frangible links interconnecting said closure and said ring, one-way interlocking features on said ring bypassing the neck upon simultaneous rotation of the closure and ring in the closing direction and engaging the neck upon rotation of the ring in the opening direction, two-way driving features on said closure and only one-way closing driving features on said ring whereby rotational force is imparted to said ring independent of said closure and only said closure can be driven in the opening direction causing said frangible links to break.

2. A tamper evident closure as in claim 1 and both said closure and said tamper evident ring are castellated about their periphery for engagement by a torque imparting tool.

3. A tamper evident closure as in claim 2 and said castellated driving feature on said closure includes radially disposed torque receiving surfaces for imparting torque in both closing and opening directions.

4. A tamper evident closure as in claim 2, and said castellated driving feature on said tamper evident ring includes a radially disposed torque receiving surface for imparting torque in a closure closing direction only.

5. A tamper evident closure as in claim 1 and said one-way interlocking features on said ring are vanes trailing radially inwardly in the closure closing direction.

6. A method of threadedly fitting a tamper evident closure to a container opening neck wherein said closure includes a tamper evident ring connected thereto by frangible links and one-way interlocking features between the tamper evident ring and neck comprising the steps of:

a) threadedly engaging a tamper evident closure on a container opening neck, b) applying a closure closing tool directly to said tamper evident closure and directly to said tamper evident ring, c) directly driving both the closure and the tamper evident ring in a closing direction and d) engaging the one-way interlocking features between the tamper evident ring and container opening neck whereby no closing torque forces arc imparted to the frangible connecting links between the closure and tamper evident ring.

7. A method as in claim 6 and applying a closure opening tool to the closure driving only the closure exclusive of the tamper evident ring whereby the frangible links are broken.

* * * * *